United States Patent [19]

Rampp et al.

[11] 4,191,433

[45] Mar. 4, 1980

[54] HOUSING FOR A DEVICE, IN PARTICULAR FOR A PRINTER

[75] Inventors: Egon Rampp, Munich; Alexander Vogel, Puchheim, both of Fed. Rep. of Germany

[73] Assignee: Siemens Aktiengesellschaft, Berlin & Munich, Fed. Rep. of Germany

[21] Appl. No.: 928,071

[22] Filed: Jul. 26, 1978

[30] Foreign Application Priority Data

Aug. 23, 1977 [DE] Fed. Rep. of Germany ..... 2737933

[51] Int. Cl.[2] ..... A47B 63/00

[52] U.S. Cl. ..... 312/183; 312/283; 312/290; 220/8; 52/67

[58] Field of Search ..... 312/183, 283, 292, 201, 312/290, 298, 301, 250, 138, 196; 220/8; 52/67, 79.5

[56] References Cited

U.S. PATENT DOCUMENTS

| | | | |
|---|---|---|---|
| 1,000,955 | 8/1911 | Shepherd | 220/8 |
| 1,764,612 | 6/1930 | Dickinson | 312/290 |
| 2,614,017 | 10/1952 | Mugnier | 312/301 |
| 2,683,953 | 7/1954 | Hopkins | 220/8 |
| 3,403,954 | 10/1968 | Williams | 312/351 |
| 3,691,671 | 9/1972 | Kroll | 52/67 |
| 3,692,230 | 9/1972 | Kapiloff | 220/8 |
| 4,084,125 | 4/1978 | King | 312/201 |
| 4,124,262 | 11/1978 | Schill | 312/238 |

FOREIGN PATENT DOCUMENTS

| | | | |
|---|---|---|---|
| 678669 | 4/1930 | France | 312/283 |

*Primary Examiner*—Victor N. Sakran

*Attorney, Agent, or Firm*—Hill, Van Santen, Steadman, Chiara & Simpson

[57] ABSTRACT

A housing assembly for non-mechanical printers consisting of a base frame having a second housing cover slidably mounted thereon through telescoping slides and a first housing cover slidably carried by the second housing cover through telescoping slides, the first housing cover being slidable over the second housing cover, the second housing cover and first housing cover being slidable beyond the base frame.

15 Claims, 6 Drawing Figures

HOUSING FOR A DEVICE, IN PARTICULAR FOR A PRINTER

BACKGROUND OF THE INVENTION

1. Field of the Invention

This invention relates to a housing cover assembly for non-mechanical printers of the type where individual areas of the printer must be freely accessible for purposes of operation and servicing.

2. Prior Art

In relatively large mechanical devices, such as non-mechanical printers, it is necessary for individual internal sub-areas of the device to be freely accessible. For example, in such printers paper stacks must be frequently exchanged. For this purpose that area of the housing of the printer in which the stacks are positioned must be readily accessible without difficulties. On the other hand, other internal of the device must also be readily accessible for servicing and checking of the printer mechanism. These other areas include, for example, the print mechanism which must be serviced and electrical assemblies which must be checked.

SUMMARY OF THE INVENTION

The principal object of this invention is to provide a housing for devices of this kind, which is arranged such that the necessary device areas are freely accessible by movement of as few cover components as possible. Any cover portion is opened operation is to not obstruct the operator or service technician.

This object is realized by providing a first cover which covers a part of a longitudinal side, for example a front side, and the top side of the device and which is designed to be movable. A second cover is provided which covers an additional part of the same longitudinal side and of the top surface or side of the device. The first cover can be moved onto the second cover, and the first cover and the second cover can be moved together beyond a basic frame which encloses the mechanism.

By displacing the first cover it is possible to expose that part of the device to which access must be most frequently obtained. For this purpose it is advantageous to use guide tracks attached to the second cover, on which the first cover can be moved.

If further areas of the device are to be exposed, it is advantageous to be able to displace the second cover along with the first cover. For this purpose an additional set of guide tracks can be provided on the base frame on which the second cover can be moved.

It is extremely advantageous to use telescoping track assemblies as the guide tracks.

A first area part can best be exposed without difficulties if the first cover is formed as a sliding door. Guidance of such a sliding door can be by means of two telescoping track assemblies affixed to second cover. In the illustrated embodiment, one telescoping track assembly is attached adjacent to a free edge of the top part of the sliding door, and the other track assembly attached adjacent to the free bottom edge of the front of the sliding door. Consequently both free edges of the sliding door move on telescopic track assemblies.

In order to avoid damage to the second cover, it is advantageous to provide the front part of the sliding door or first cover with rollers by means of which the sliding door can contact the second cover without damage. In order to prevent the first cover from undesirably moving past the second cover, a stop means, which may comprise a rubber bumper, is provided at the end of the second cover. When moved, the first cover will abut against the stop means.

However, it is advantageous to provide fro movement of the first cover beyond the second cover, for example in order to clean the glass plates of the sliding door. For this purpose the telescoping tracks positioned on the second cover are of the type which can be both sides. When the stop means on the second extended cover is removed, the first cover can them be moved past the second cover.

In order to prevent the second cover from being displaced when the sliding door is moved onto it, the basic frame may be provided with a lock device locking the second cover to the base frame. Expediently, the second cover comprises an openable service door which in its closed state lies adjacent to the front and top sides of the device and which further includes a frame portion connected to the service door.

In order to make the second cover displaceable on the base frame, three telescoping track assemblies are secured to the basic frame. The first telescoping track assembly is positioned to the free or back edge to part of the service door, the second track assembly is positioned adjacent to the free edge of the front part of the door, and the third track assembly is positioned adjacent the middle part of the front side of the service door. Thus the second cover is supported at three points by telescoping tracks. As the second cover can be displaced, together with the first cover, beyond the base frame, the service door and the frame of the second cover are provided with rollers for resting on the base when the first and second covers are removed from the device. As it is also possible to remove only the sliding door or first cover from the device, the sliding door is also provided with rollers.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

DESCRIPTION OF PREFERRED EMBODIMENTS

Figure 1:
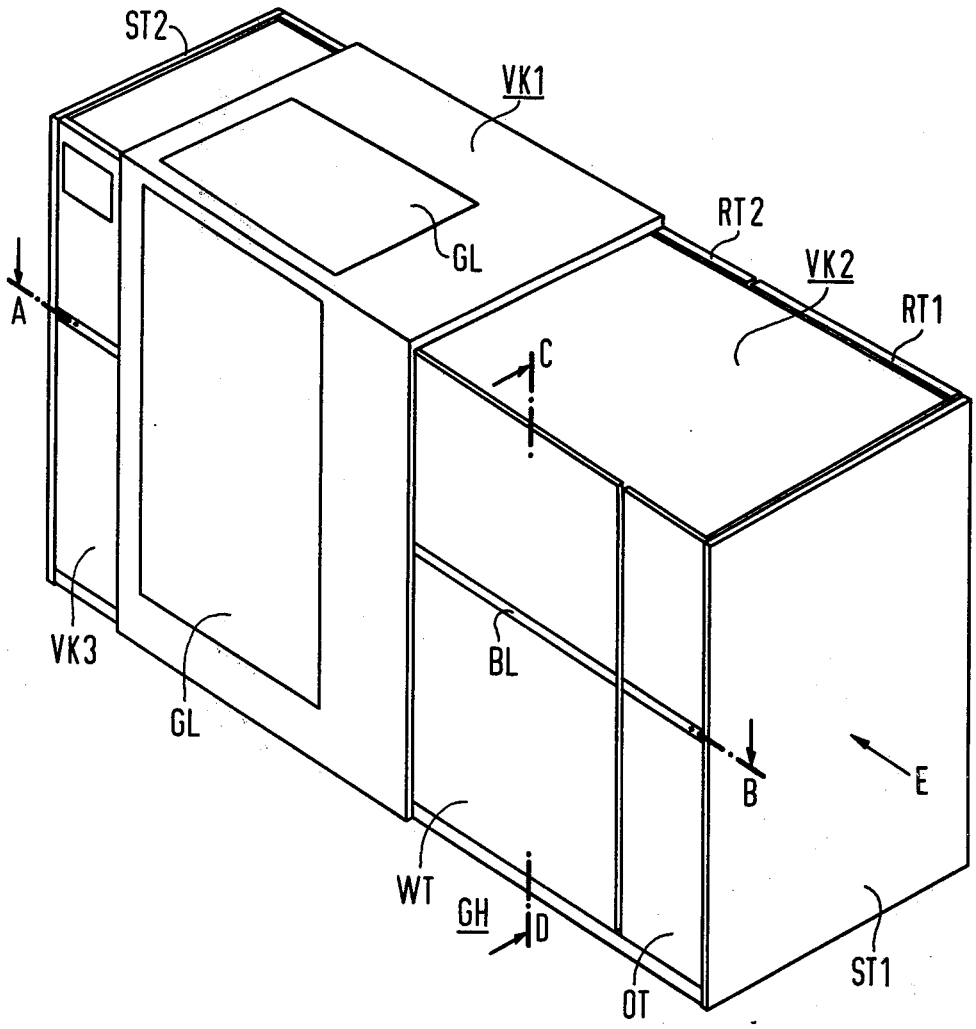
FIG. 1 is a perspective view of the housing of the the device, in a closed position.

FIG. 1 shows a non-mechanical printer with a housing according to this invention. The housing GH is shown in the closed state. The housing GH consists of a first cover $VK_1$, is formed as a sliding door and is privided with two glass plates GL. In the closed state, the sliding door extends over a part of the longitudinal or front side of the device and over upper part or top side of the device. The second cover $VK_2$ includes a service door WT which in the closed state extends over another part of the device and in fact over a part of the longitudinal side and the upper side. Furthermore the second cover $VK_2$ includes a side wall component $ST_1$. The housing GH is completed by a further cover $VK_3$ which serves to cover the remainder of the device on the front side and the top side.

Figure 2:
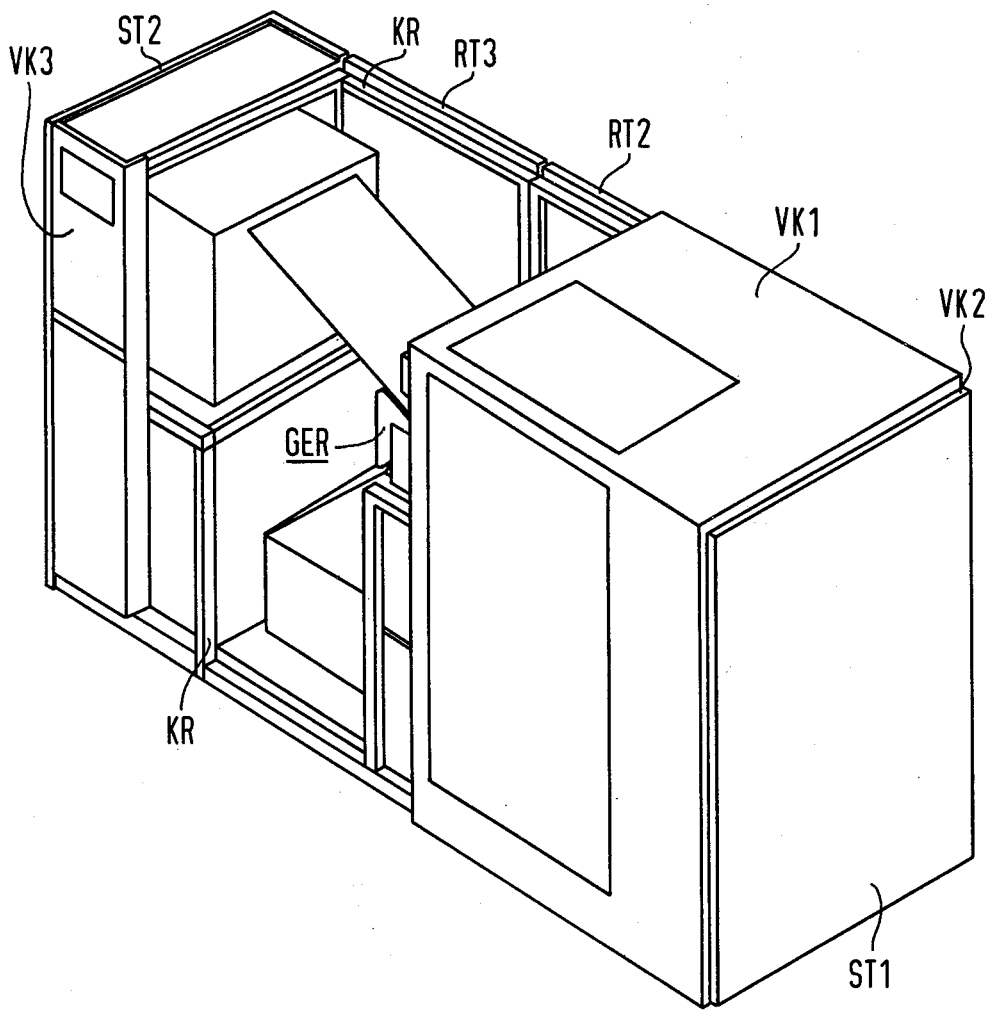
FIG. 2 is a perspective view of the housing with the first cover open.

FIG. 2 illustrates the housing when the sliding door $VK_1$ has been moved onto the cover $VK_2$. As a result, a part of the interior of device is exposed. In a printer for example this can be that region of the printer GER device in which the stacks of paper are positioned.

Those parts of the housing GH illustrated in FIG. 1 are again shown. However, the sliding door $VK_1$ has now been moved onto the cover $VK_2$. As a result a part of a basic frame KR is exposed. The printing assembly GER is secured to this base frame KR. The rear walls $RT_2$, $RT_3$ which can be openable doors are also shown.

Figure 3:
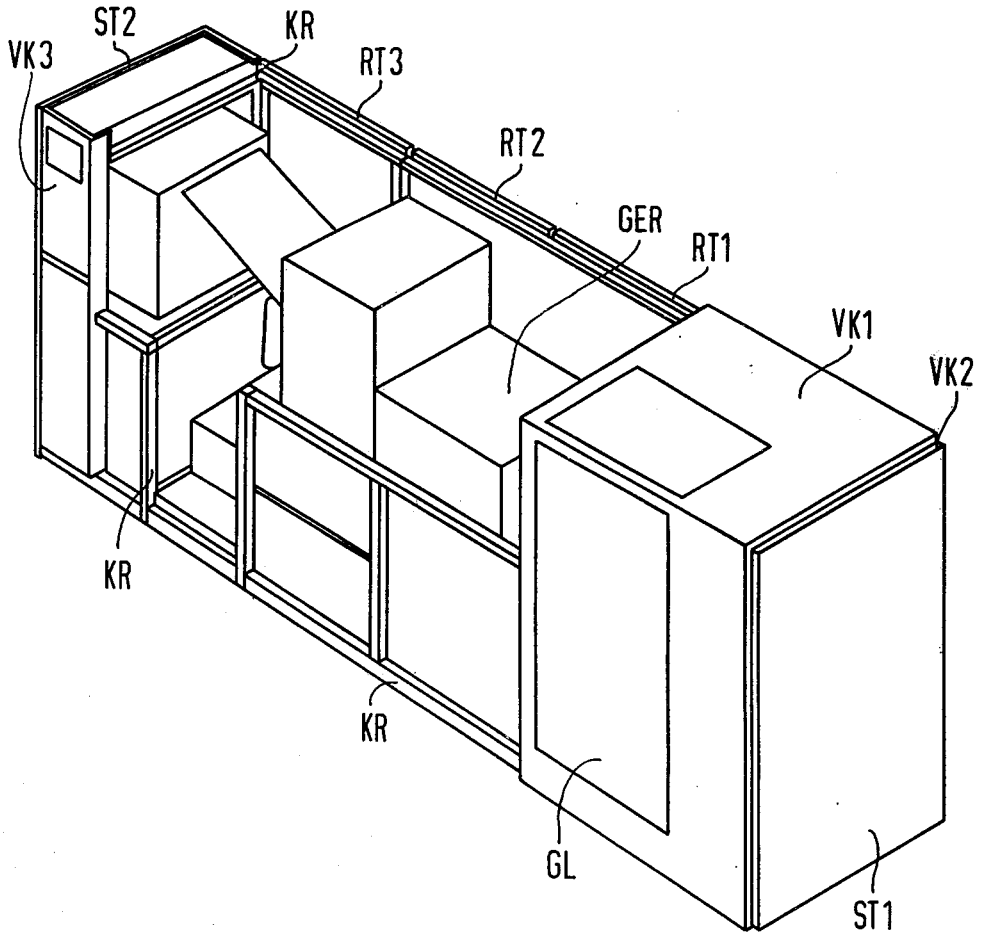
FIG. 3 is a perspective view of the housing when both covers are removed from the device.

If the assembly GER is to be further exposed, the sliding door $VK_1$ together with the second cover $VK_2$ can be removed from the basic frame KR. This is illustrated in FIG. 3. Here a further back wall $RT_1$ is exposed which can also be a door.

Thus as shown in FIGS. 1–3, parts of the interior device GER can be exposed without difficulties simply by moving parts of the cover with respect to the device GER and the base frame KR. The other parts of the device GER can be exposed by designing the rear walls $RT_1$ to $RT_3$ and the side walls $ST_2$ and $ST_1$ as doors which can be opened.

Figure 4:
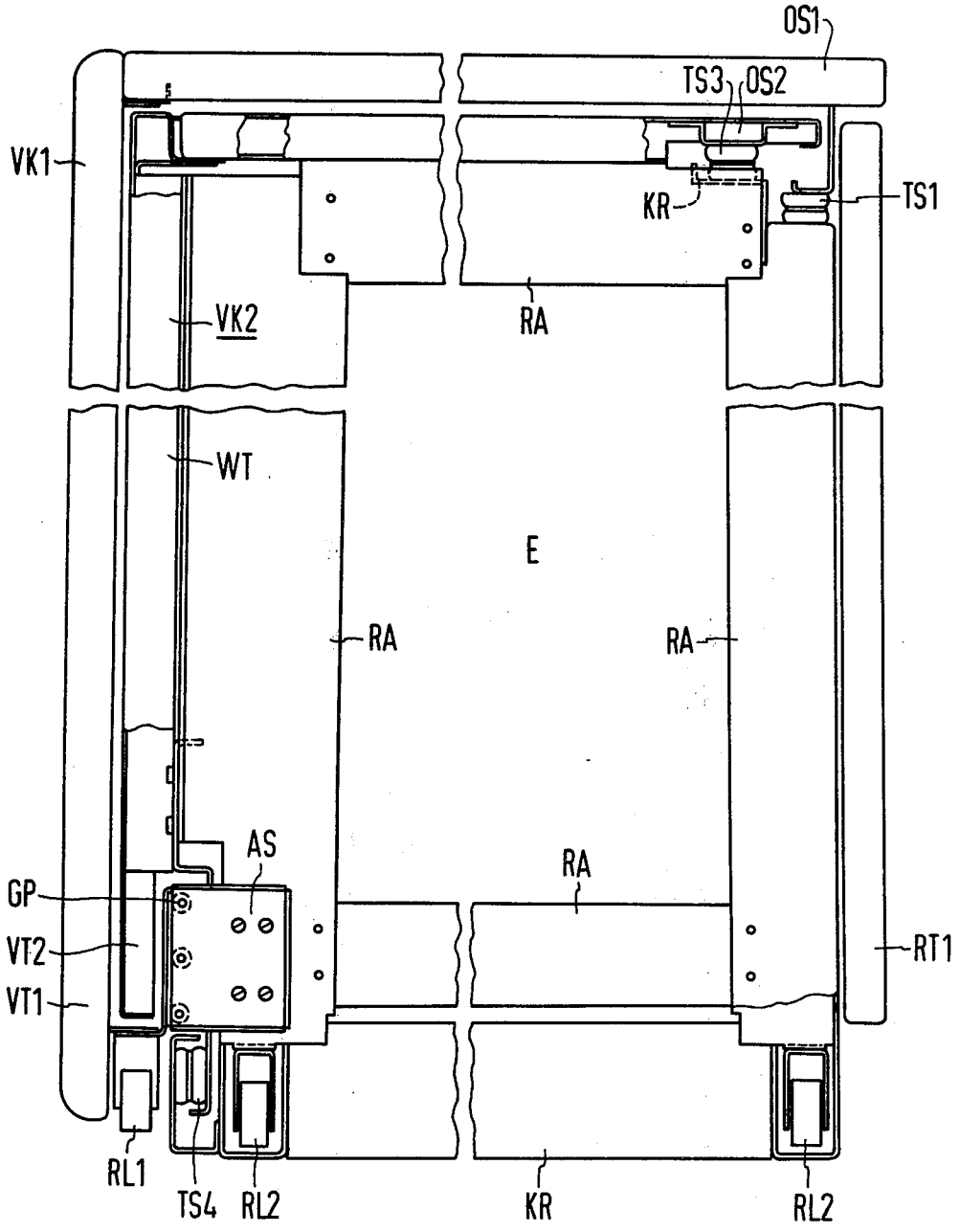
FIG. 4 is an end view with portions removed of the housing in the direction E of FIG. 1.

FIG. 4 is an end view in the direction E (FIG. 1) with the side door $ST_1$ removed. The sliding door or first cover $VK_1$ is again shown. Beneath this the second cover $VK_2$ consisting of a service door WT and a frame RA is shown. A part of the service door WT, e.g. the operator door OT, can be pivoted to the frame RA. Only a part of the base frame KR has been shown.

The sliding door of first cover $VK_1$ which covers a part of the longitudinal or front side and of the upper or top side of the device, moves on telescoping track assemblies TS of a type known in the art. One of these telescoping tracks $TS_1$ is illustrated in FIG. 4. It is positioned between the frame RA of the cover $VK_2$ and the free edge of the top side of the sliding door $VK_1$. This top side is referenced $OS_1$. The second telescoping track assembly for guidance of the sliding door $VK_1$ is not visible in FIG. 4. It lies behind a stop means AS.

Stop means AS is provided to stop the sliding door $VK_1$ when the sliding door $VK_1$ is moved onto the second cover $VK_2$. The stop means AS may be provided with rubber bumpers GP against which the sliding door $VK_1$ abuts. The stop means AS is designed to be removable in order to allow the sliding door $VK_1$ to be moved past the second cover $VK_2$, for example, when cleaning the glass GL. In order to allow the sliding door $VK_1$ to rest against the base, it is provided with rollers $RL_1$ on its front part $VT_1$. One of these rollers is visible in FIG. 4, and the other is arranged at the other end of the front part $VT_1$ of the sliding door $VK_1$.

Figure 6:
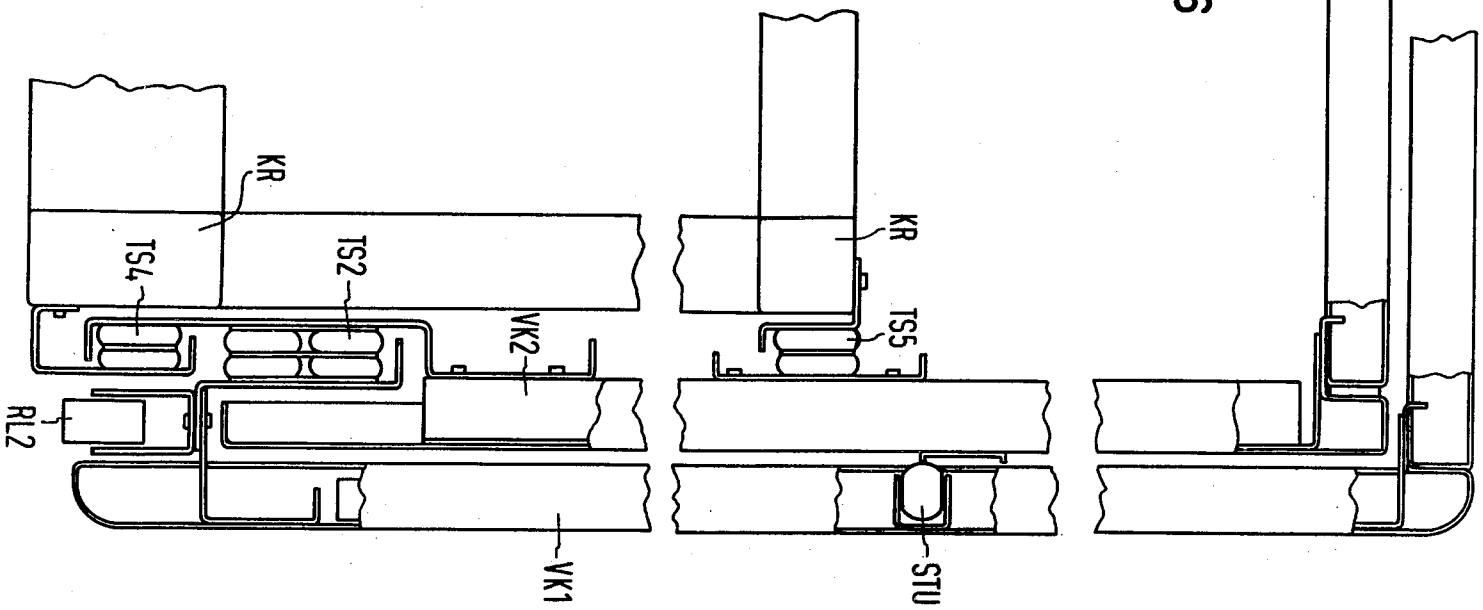
FIG. 6 is a sectional view of the housing along line CD of FIG. 1.

The second cover $VK_2$ with its service door WT and frame RA is positioned below the first cover KI. The second cover $VK_2$ moves on three guide tracks, which are likewise telescoping track assemblies, two of which are illustrated in FIG. 4. These track assemblies $TS_3$ and $TS_6$ are secured to the basic frame KR. This provides a guidance for the top of the cover $VK_2$. THe second track $TS_4$ for the second cover $VK_2$ lies between the free edge of the front part $VT_2$ of the cover $VK_2$ and the basic frame KR. This provides guidance for the front longitudinal side of the second cover $VK_2$. The position of the third telescoping track $TS_5$ is shown in FIG. 6.

The second cover $VK_2$ is provided with rollers $RL_2$ with the aid of which the second cover can rest on the base when the first cover $VK_1$, together with the second cover $VK_2$, has been removed from the device to the side thereof. A second roller $RL_2$ is in each case arranged at the other end of the cover $VK_2$.

Figure 5:
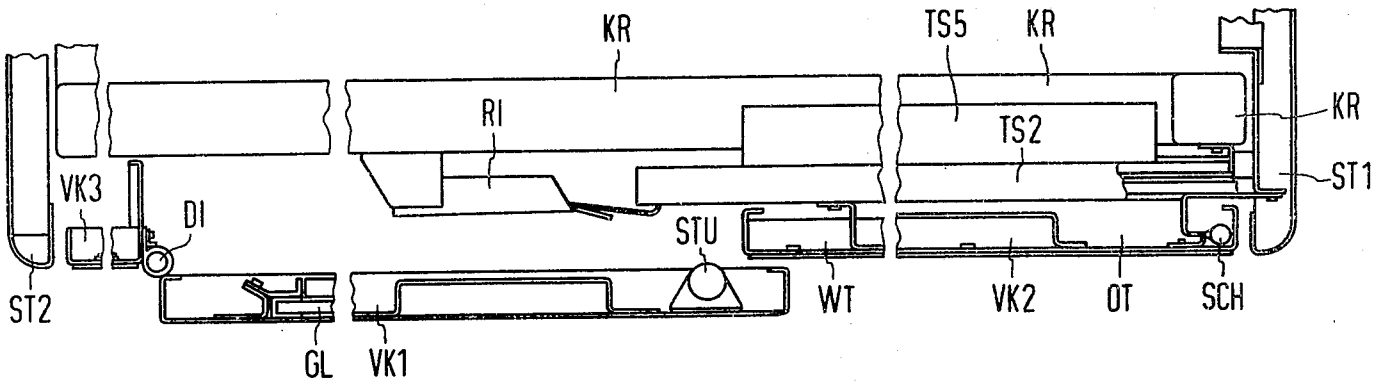
FIG. 5 is a sectional view of the housing along line AB of FIG. 1.

FIG. 5 illustrates a view taken along line A–B of FIG. 1. Here only the front portion of the housing GH is shown in the cross section as only this part is necessary to explain the functions of the housing. A locking device RI secured to the base frame KR serves to lock the second cover $VK_2$. The second cover $VK_2$ is illustrated in panthom. The front side of the cover $VK_2$ can, for example, include a rotatable door OT which can be rotated about hinge SCH. In the area of the second cover $VK_2$ is shown the telescoping track $TS_2$ which is secured to the second cover $VK_2$ and upon which the sliding door $VK_1$ moves. In addition to this track $TS_1$ there is shown a further telescoping track assembly $TS_5$ which is attached to the base frame KR and upon which the second cover $VK_2$ moves.

FIG. 5 also shows the sliding door $VK_1$, in its closed state. Here the cover $VK_1$ rests against a seal DI which is attached to the cover $VK_3$. A portion of glass plate GL can also be seen. The sliding door $VK_1$ is provided with support rollers STU by means of which it can rest against the cover $VK_2$ when the sliding door is moved onto the second cover $VK_2$. Parts of the side doors $ST_1$ and $ST_2$ are also shown.

Finally FIG. 6 is taken along line C–D of FIG. 1. Again only the front portion of the housing has been shown.

The sliding door $VK_1$ is postitioned over the second cover $VK_2$. Here telescoping track $TS_2$ has been shown upon which the sliding door $VK_1$ moves and which is attached to the second cover $VK_2$. Also shown is the roller $RL_2$ upon which the sliding door $VK_1$ can rest when it is moved beyond the second cover $VK_2$. In the central region of the sliding door $VK_1$ support roller STU are positioned which move along a groove BL on the second cover $VK_2$ and which prevent the second cover $VK_2$ from being damaged by the sliding door.

The second cover $VK_2$, and its service door WT, are positioned adjacent the sliding door $VK_1$. It can be seen that the third telescoping track $TS_5$ lies in the central region of the longitudinal side of the cover. This telescopic track is secured, on one hand, to the base frame KR and on the other hand to the service door WT. The track assembly $TS_4$ is positioned at the lower end of the front part of the cover $VK_2$ and, on one hand, is secured to the basic frame KR and on the other hand to the second cover $VK_2$.

The function of the housing will be briefly described in the following. In the closed state, the sliding door $VK_1$ lies adjacent to the cover $VK_3$, as shown in FIG. 1, and the entire device GER is covered by the cover VK.

If a first part of the device is to be rendered accessible, the sliding door $VK_1$ is moved onto the cover $VK_2$, running on the telescoping tracks $TS_1$ and $TS_2$. This exposes that part of the device GR to which access is most frequently required. During this sliding process, the sliding door $VK_1$ abuts against the stop means AS. Damage to the second cover $VK_2$ by the sliding door $VK_1$ is prevented by the support rollers STU which can be formed, for example, of synthetic material.

If a further part of the device is to be rendered accessible, the locking device RI is released. Now the second cover $VK_2$ together with the first cover $VK_1$ can be moved away from the basic frame KR and thus from the device GER. The second cover $VK_2$ moves on the telescoping tracks $TS_3$ to $TS_5$. The roller $RL_1$ provide support on the base. Thus the major part of the device GER has been exposed simply by displacing two cover components.

If, however, only the sliding door $VK_1$ is to be removed from the device GER and in fact beyond the second cover $VK_2$, the second cover $VK_2$ remains locked by the locking device RI. As the telescoping tracks $TS_1$ and $TS_2$ can be extended in two directions, i.e. in the direction of the cover $VK_3$ and in the opposite direction, the sliding door $VK_1$ can be displaced beyond the cover $VK_2$. In this case the sliding door $VK_1$ rests by means of the rollers $RL_2$ on the base.

The cover $VK_1$ can only be displaced in this way beyond the cover $VK_2$ when the stop means AS has been removed.

Closure of the device by the cover VK is carried out in opposite sequence. First the two covers $VK_1$ and $VK_2$ are moved onto the device until the second cover $VK_2$ engages with the locking device RI. Then the sliding door $VK_1$ can be moved forwards until it abuts against the sear DI. Thus the housing around the device GER is closed.

Although the teachings of my invention have herein been discussed with reference to specific theories and embodiments, it is to be understood that these are by way of illustration only and that others may wish to utilize my invention in different designs or applications.

I claim as my invention:

1. A housing for a non-mechanical printer device wherein individual areas of the internal mechanism of the printer are to be freely accessible for purposes of servicing and operation comprising a housing including at least first and second cover portions, said first cover covering a portion of a top of said device and a portion of a first longitudinal side of said device, said second cover providing a cover for a second portion of said device and a second portion of said first longitudinal side of said device, the first cover being longitudinally movable from a covering position to a position exposing a portion of said device with the first cover in the position exposing the portion of the said device lying over the second cover, the first and second covers being jointly movable to a third position exposing a greater amount of the interior of the device, movement to the third position being longitudinal movement to a position substantially beyond the majority of the device whereby movement of the two covers to the third position gives free access from at least the top and a first longitudinal side to a significant portion of the interior of the device.

2. A housing as defined in claim 1 wherein the first cover is moved on guide tracks affixed to the second cover.

3. A housing according to claim 2 wherein the second cover is moved on guide tracks affixed to a base frame of the device.

4. A housing according to claim 3 wherein the guide tracks are telescoping guide tracks.

5. A device according to claim 4 wherein the first cover comprises a sliding door consisting of a front portion at the first longitudinal side and a top portion overlying a top of the device, that at least two telescoping track assemblies are provided for guidance of the sliding door over the second cover, that one of said telescoping track assemblies is positioned between the top part of the sliding door adjacent the free edge thereof and the second cover, that a second telescoping track assembly is positioned between the front part of the sliding door adjacent a free edge thereof and the second cover.

6. A housing according to claim 5 including support rollers affixed to an undersurface of the front part of the sliding door, the support rollers contacting the second cover when the sliding door is moved onto the second cover.

7. A device according to claim 4 wherein a stop means is affixed to the second cover, said stop means being abutted by an edge of the sliding door when the sliding door is fully moved onto the second cover, said stop means including resilient bumpers.

8. A device according to claim 5 wherein the telescoping tracks positioned between the sliding door and the second cover are extensible in both longitudinal directions relative to the second cover.

9. A device according to claim 8 wherein the stop means is removable such that the sliding door can be longitudinally moved beyond the second cover in a direction away from a first covering position of the sliding door.

10. A device according to claim 1 wherein lock means are provided between a base frame of the device and the second cover restricting movement of the second cover.

11. A housing according to claim 5 wherein the second cover comprises a service door which in a closed state overlies portions of the front side and top side of the device and of a base frame.

12. A housing according to claim 11 wherein a plurality of telescoping track assemblies are affixed to the base frame and to the second cover allowing longitudinal movement of the second cover with respect to the base frame, at least one track positioned adjacent the free end of the top part of the service door, at least a second track positioned adjacent the free edge of the top part, at least a second track positioned adjacent the free edge of the front part and a third track positioned between a middle portion of the front side of the service door and the base frame.

13. A device according to claim 12 including roller affixed to the service door supporting the service door with respect to the frame when the service door is moved beyond the device.

14. A device according to claim 13 wherein rollers are affixed to the sliding door providing support for the sliding door when the sliding door is moved beyond the service door.

15. A housing for a device such as a non-mechanical printer comprising a base frame, a first sliding cover portion, a second sliding cover portion, extensible track means affixed respectively to the second cover and the base frame allowing movement of the second cover with respect to the base frame, second extensible track means affixed respectively to the first cover and the second cover allowing movement of the first cover with respect to the second cover, the second track means allowing movement of the first cover to both sides of the second cover whereby the first cover may be moved from a device enclosing position to a second position giving access to the device interior of the cover, the first cover overlying the second cover in the second position, the first and second covers being movable together to a third position giving further access to the interior of the device with the first and second covers in the third position lying beyond a substantial portion of the device, the first cover being a sliding door overlying, in its closed covering position portions of the device requiring most frequent access.

* * * * *